United States Patent [19]

Lopez et al.

[11] Patent Number: 4,739,599

[45] Date of Patent: Apr. 26, 1988

[54] ENERGY DISSIPATION STRUCTURE FOR SECURING LIGHTWEIGHT ROOFING ELEMENTS

[75] Inventors: Serapio E. Lopez, Houston, Tex.; David L. Roodvoets, Westerville, Ohio

[73] Assignee: The Dow Chemical Company, Midland, Mich.

[21] Appl. No.: 6,832

[22] Filed: Jan. 27, 1987

[51] Int. Cl.[4] ..... E04B 5/00; E04B 7/00

[52] U.S. Cl. ..... 52/410; 52/512; 52/513; 52/746

[58] Field of Search ..... 411/907; 220/435, 437, 220/438, 464, 468, 461; 52/410, 408, 746, 222, 512, 513

[56] References Cited

U.S. PATENT DOCUMENTS

| | | | |
|---|---|---|---|
| 3,191,568 | 6/1955 | Schroeder et al. | 220/468 |
| 3,343,227 | 9/1967 | Brown et al. | 52/408 |
| 3,562,987 | 2/1971 | Eakin | 52/269 |
| 3,829,150 | 8/1974 | Moore | 411/907 |
| 4,441,295 | 4/1984 | Kelly | 52/746 |
| 4,616,455 | 10/1986 | Hewison | 52/410 |

*Primary Examiner*—James L. Ridgill, Jr.

[57] ABSTRACT

A wind-resistant inverted built-up roof construction is provided comprising a roof deck, a waterproof membrane overlying said roof deck, a plurality of closed cell foam plastic insulation material overlying said membrane, and a plurality of paving blocks overlying and supported by said insulating members in edge-to-edge relationship. A plurality of resilient members is secured relative to said membrane and extend past the insulating blocks. A plurality of hold-down plates respectively overlie a plurality of the paving blocks, and each plate is aligned with and secured to one of said resilient members in order resiliently to hold said paving blocks in place.

11 Claims, 2 Drawing Sheets

ENERGY DISSIPATION STRUCTURE FOR SECURING LIGHTWEIGHT ROOFING ELEMENTS

BACKGROUND OF THE INVENTION

For many years it was the universal practice to construct roofs with a waterproof layer or membrane on the outer surface thereof. Such roofing is still used in many installations, but has many disadvantages. The waterproof membrane, which may be built-up sheet material and asphaltic or bitumin, or which may be a single sheet of waterproof material, is exposed to extreme temperature variations, as much as 200 degrees Fahrenheit, to ultraviolet radiation, and to physical abrasion, all of which have a detrimental effect on the life of the roofing.

It has been common practice for many years to provide insulation in roof construction, and when insulation is provided below the waterproof membrane, in the roofing system outlined above, it is necessary to provide a second waterproof membrane below the insulation to prevent moisture from within the building from condensing in the insulation and inhibiting or destroying the insulating qualities.

An alternative up-side-down roofing construction is known in which the insulation is applied over the waterproof membrane, see for example U.S. Pat. Nos. 3,411,256 and 3,763,614. In this alternative roof construction the waterproof membrane, which may be a built-up membrane or a single waterproof layer such as a thermoplastic or an elastomer, is applied directly to the surface of the roof. Blocks of foam plastic insulation are then applied over the waterproof membrane. STYROFOAM (Trademark of The Dow Chemical Company) brand foam polystyrene plastic insulation is a superior product for such use. It is a tough, closed-cell, rigid plastic foam having excellent moisture resistance and high compressive strength.

The foam polystyrene plastic insulation placed over the waterproofing membrane rather than under the membrane protects the membrane from the effects of thermocycling, temperature extremes, and physical abuse, thus reducing maintenance and prolonging the life of the entire roofing system. It has been found that the membrane so protected remains at stable temperatures below 100 degrees F. even in hot summer weather. In fact, under normal conditions, the temperature of the membrane will remain within 15–20 degrees F. of the building's inside temperature.

Typically, a polymeric fabric is installed over the foam to stabilize the system, and crushed stone or gravel ballast is applied to counteract the buoyancy of the insulation boards, to provide flammability resistance to the roof surface, and to shield the foam and fabric from ultraviolet radiation. As an alternative, paving blocks may be used in place of stone, particularly if traffic is to be expected on the roof. One such roofing system has been disclosed in co-pending application Ser. No. 639,751, filed Aug. 10, 1984 by David L. Roodvoets, and assigned to the same assignee as the present application, The Dow Chemical Company of Midland, Mich., U.S.A.

In some such inverted roofing installations utilizing lightweight concrete paving blocks over foam plastic insulation, there is a tendency for the wind to lift the paving blocks and insulation, and even to blow them from the roof deck. This is particularly true if each paving block and insulation slab is not thoroughly anchored to the roof deck. The situation can be particularly bad when the foam insulation and lightweight paving blocks are placed over unattached, single-ply membranes. The single-ply membranes can be pressurized from below, due to building pressures and/or wind pressure getting beneath the membrane. When such pressurization occurs, the membrane will tend to billow or to form a balloon, and dump the paving blocks and insulation off the surface and expose them to the wind.

OBJECTS AND SUMMARY OF THE PRESENT INVENTION

It is an object of the present invention to utilize energy dissipation means anchoring lightweight concrete paving blocks on top of foam plastic insulation in an inverted built-up roof system.

More particularly, it is an object of the present invention to provide energy dissipation means as in the previous object, which energy dissipation means is anchored to the underlying waterproofing membrane without interrupting the integrity of the waterproofing membrane lying on top of the deck.

In attaining the foregoing and other objects of the present invention, we use a spring or other elastic means which is anchored to the waterproofing membrane by means maintaining the integrity of a waterproof membrane overlying the deck. The spring or elastic means extends above foam plastic insulating slabs overlying the waterproof membrane and is connected to a respective plate overlying the junction of three or four lightweight concrete paving blocks. When a wind tends to lift the paving blocks and/or the foam plastic insulating slab, the spring or elastic means allows the paving blocks and the foam plastic insulating slab to rise a limited extent, thus relieving strains in the system. Upon diminution or cessation of the wind, the springs or other elastic elements return the paving blocks and insulating slabs to their normal position. The foam insulating slabs and concrete paving blocks can be separate, or they may be integral. For example, the STYROFOAM LIGHTGUARD roof insulation sold by The Dow Chemical Company, comprises extruded polystyrene foam with a nominal ⅜" thick facing of latex modified concrete mortar, see U.S. Pat. No. 4,067,164, and this can be used instead of the separate insulating slabs and paving blocks.

THE DRAWINGS

The present invention will best be understood with reference to the following specification when taken in connection with the accompanying drawings wherein.

DETAILED DISCLOSURE OF THE ILLUSTRATED EMBODIMENTS

Figure 1:
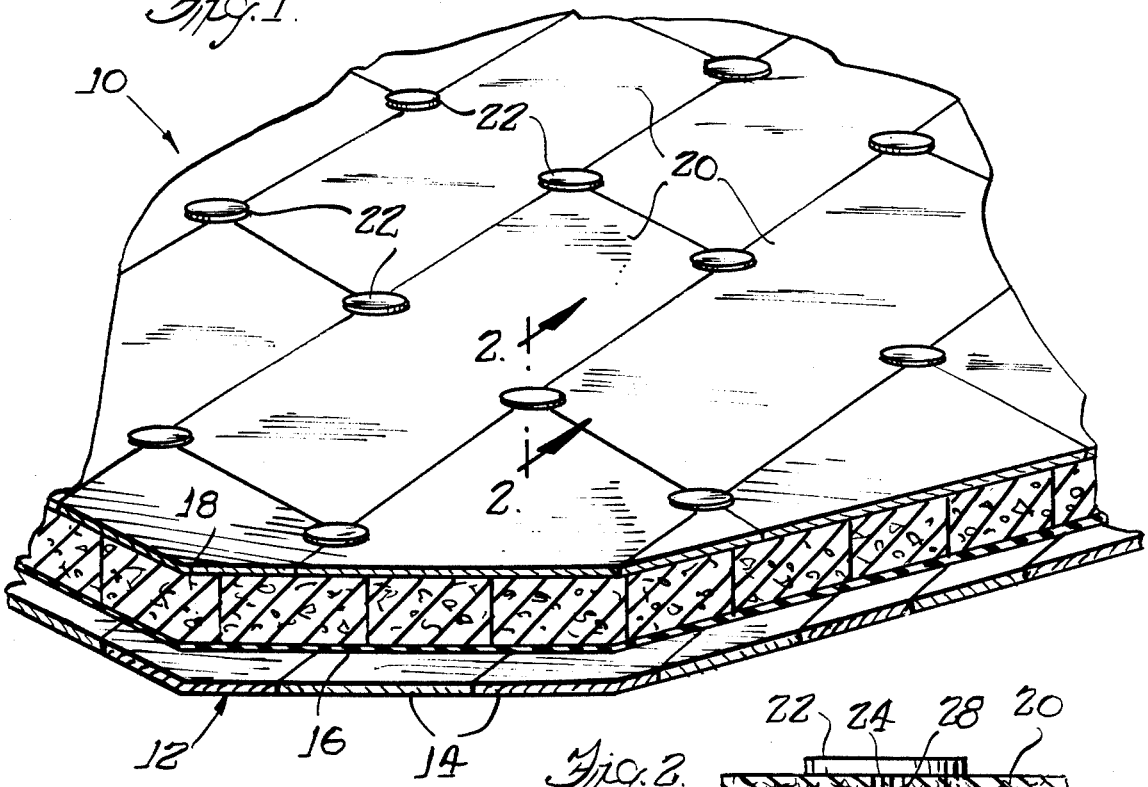
FIG. 1 is a partial perspective view of a roofing system constructed in accordance with the present invention.

Turning now in greater particularity to the drawings, and first to FIGS. 1–4, there will be seen a built-up roof construction identified generally by the numeral 10. The roof construction includes a roof deck 12 comprising a plurality of edge-to-edge wood boards 14 supported by suitable joists or girders (not shown). The roof deck 12 could equally well be of steel construction, or it could be a concrete slab, suitably supported. A waterproof membrane 16 lies on and is supported by the roof deck 12. This membrane could be a built-up construction comprising sheet material with asphalt or bitumin, or it could be a single waterproof layer, such as of thermoplastic material. An elastomeric material of a single thickness also is a possibility, and the membrane is so illustrated.

Blocks or slabs of foam plastic insulation 18 lie on the membrane 16, and optionally may be cemented thereto. Alternatively, the cement blocks and insulation may be integral as in The Dow Chemical Company STYROFOAM LIGHTGUARD roof insulation mentioned earlier. The insulation preferably comprises foam polystyrene plastic resin, and STYROFOAM foam plastic insulation made by The Dow Chemical Company is a preferred example. The concrete paving blocks substantially abut one another in edge and end relationship. The concrete paving blocks preferably utililze a lightweight aggregate, and preferably are reinforced by means such as a continuous web or screen mesh, or chopped strands of fibers, although plastic such as polypropylene can be used. A fiber length of ¼″ to 1″ is preferable. The concrete preferably is modified containing a latex, such as styrene-butadiene latex, or ACROSYL (Trademark of PPG Industries), a latex acrylic. Other latexes could be used. The paving blocks preferably are on the order of 1″ thick and are on the order of 3′×6′. The thickness of the foam insulating panels depends on the degree of insulating quantity desired, but typically would be on the order of 1″–6″. The polystyrene foam is of the closed cell variety for moisture resistance, and the panels preferably are on the order of 2′×4′, although other dimensions are contemplated. The foam panels may simply be butted together, or may be interconnected by a shiplap or tongue and groove construction.

Figure 2:
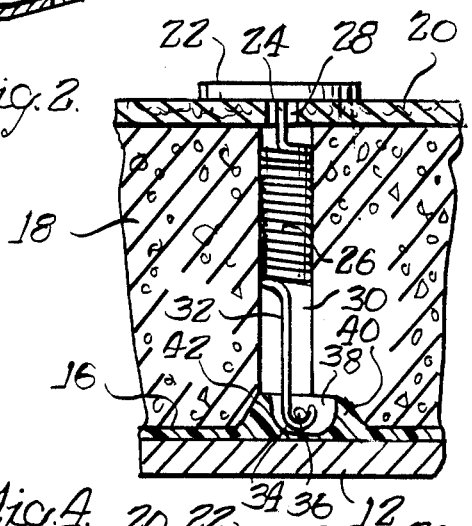
FIG. 2 is a cross-sectional view taken, for example, substantially along the line 2—2 in FIG. 1.
Figure 3:
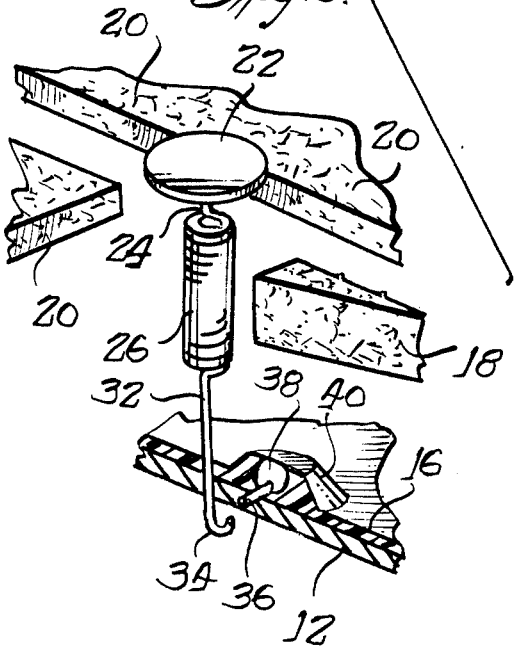
FIG. 3 is a perspective view of the parts shown in FIG. 2.
Figure 4:
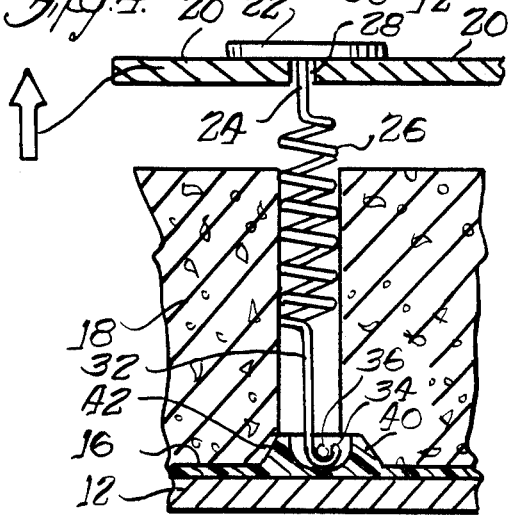
FIG. 4 is a view similar to FIG. 2 showing the paving blocks as raised by a wind.
Figure 5:
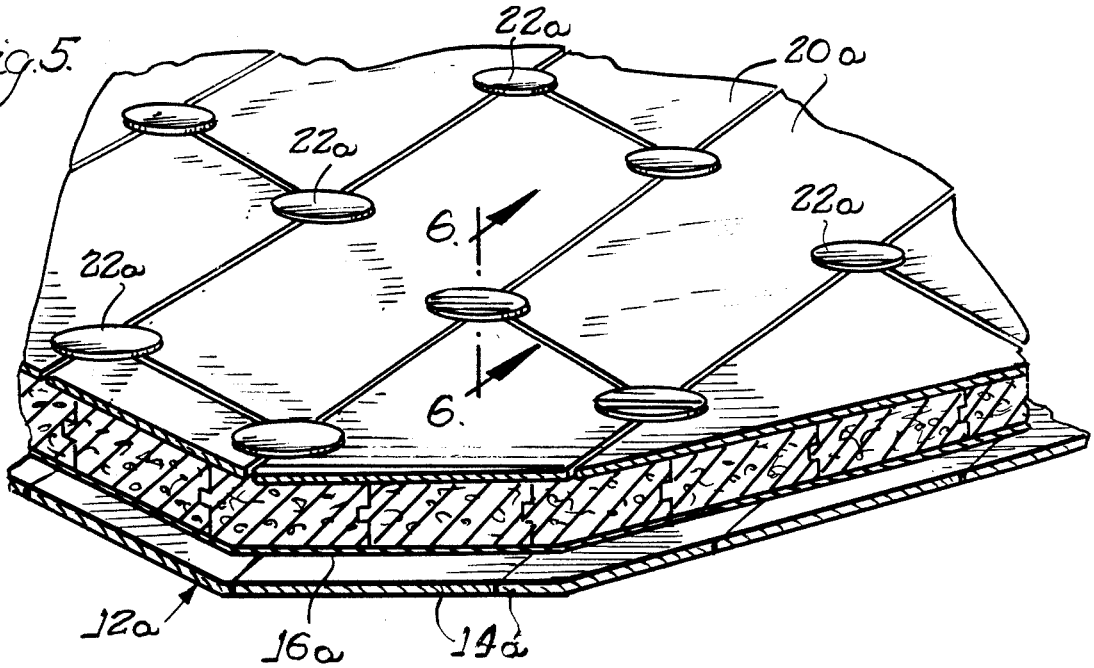
FIG. 5 is a view similar to FIG. 1 showing a modification of the invention.

The concrete blocks 20 may be laid so that the junctions between blocks may be in the nature of four-way crossovers. However, preferably adjacent blocks are offset longitudinally as shown in FIG. 1 so that the intersections among adjacent blocks are in the nature of T-intersections. Each intersection is covered by a thin steel plate which preferably is round or rectangle in outline, and which provides means extending between adjacent blocks 20 and corrosion-resistant, being galvanized, or stainless steel, although other corrosion-resistant metals or materials may be satisfactory. As may be seen in FIGS. 2–4, one end 24 of a spring 26, preferably a helical spring, is secured to a respective disk or plate 22, such as by welding. The spring also is corrosion-resistant, and may be galvanized steel or stainless steel. The upper end 24 of the spring fits through an opening 28 between blocks. This opening may be formed by notching the blocks, or by simply spacing the blocks slightly. The spacing illustrated in FIGS. 2 and 4 is greater than is actually necessary, and is for purposes of illustration. Most of each spring 30 extends through a vertical hole 30 through the foam plastic insulation 18, and this may be formed by slightly spacing adjacent blocks of insulation, but preferably is a specially-formed tubular hole through the insulation. The lower end 32 of each spring is formed by the terminating hook 34, and this hook fits over a crosspin 36 in an upwardly opening recess 38 in an upstanding boss 40 formed integrally with the membrane 16. The undersurface of the foam plastic insulation may be recessed at 42 to accomodate the boss. However, the boss is somewhat exaggerated in size in the drawings for purposes of illustration and the compressibility of the elastomeric substance of the membrane and of the foam plastic insulation may be enough to accommodate without the necessity of providing a specific recess 42.

Normally the springs 26 and disks or plates 22 hold the concrete blocks 20 down flat on top of the foam insulation 18, and hold the insulation down tight against the membrane 16. However, in the case of a strong wind which might tend to raise and blow off the blocks 20, the blocks may raise up against the forces of the springs 26 as shown in FIG. 4. The foam insulation slabs 18 may also rise, although this is not specifically illustrated. This relieves stresses on the roofing system, and upon diminution or subsiding of the wind, the concrete blocks 20 will again be pulled down on top of the foam plastic insulation slabs as shown in FIGS. 1 and 2.

Figure 6:
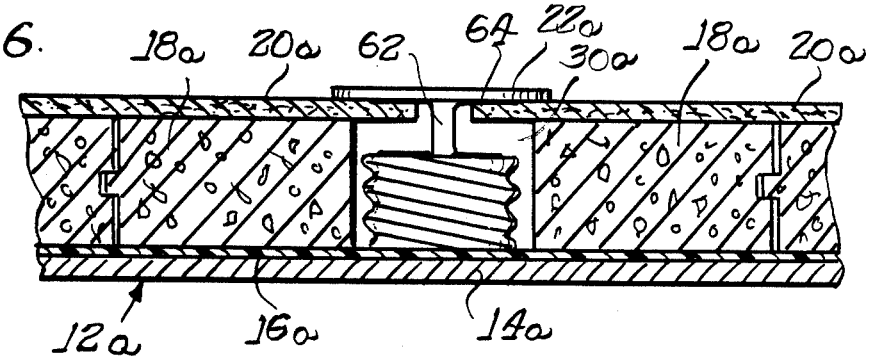
FIG. 6 is a cross-sectional view taken substantially along the line 6—6 in FIG. 5.
Figure 7:
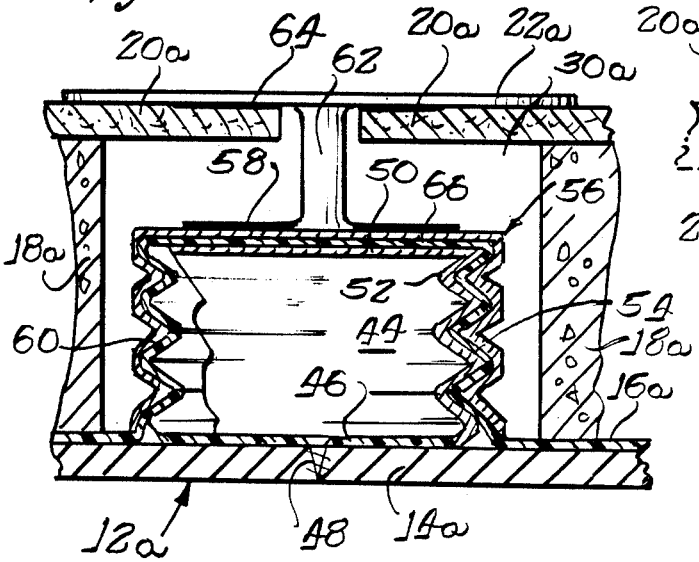
FIG. 7 is an enlarged view of the central portion of FIG. 6.
Figure 8:
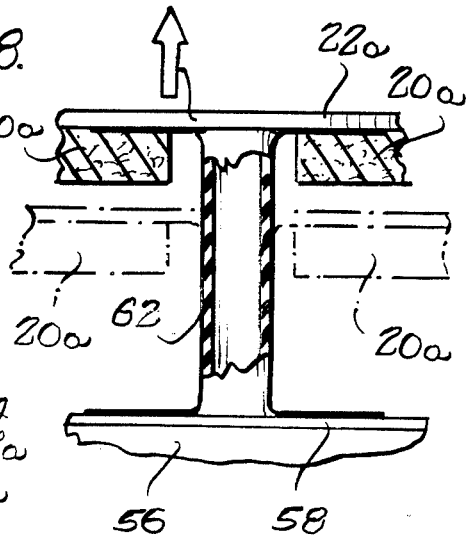
FIG. 8 is a view on a further enlarged scale of a portion of FIG. 7, but showing the paving blocks as raised by the wind.

A modification of the invention is shown in FIGS. 5–8. Many of the parts are the same as or similar to those previously disclosed and are identified by similar reference numerals with the addition of the suffix a to avoid repetition of description. The distinction lies in the anchoring or hold-down structure whioh uses an elastic material rather than a metallic spring, and which uses a two-piece metal or plastic structure for anchoring to the roof deck without disturbing the integrity of the membrane. Thus, as seen in FIGS. 6–8, the hold-down structure comprises a hollow anchor block 44 of metal or plastic construction having a flat bottom wall or floor 46 with a screw shank 48 secured to the bottom thereof by suitable means such as welding or cementing for securing the box or body 44 to the boards **14*a* of the roof deck 12*a*. The body 44 further includes a flat top wall 50 parallel to the bottom wall or floor 46, and a serrated or pleated side wall 52. The side wall 52 may simply consist of alternating hills and valleys, but more preferably is arranged as a screw-threaded ridge and valley. The membrane 16*a* is provided with an upstanding portion 54 fitting over the body 44**. This may be accomplished by using a heat-softenable plastic resin for the membrane, or the membrane may be manufactured with upstanding portions thereon. An elastomeric rubber membrane such as ethylene-propylene-diene or butyl rubber will stretch over the hold-down structure.

An outer shell 56 substantially conforms to the exterior of the body or box 44 and comprises a flat top wall 58 and a serrated or pleated side wall 60 having alternating ridges and valleys. The outer shell 56 grips the upstanding portion 54 of the membrane **16*a* about the body or box 44. Assembly is not difficult in the case of a screw-threaded side wall. If simply alternating ribs and valleys are provided parallel to one another, then either the ribs and valleys must not be too deep, or the side wall must have vetical slots to allow it to expand to ratchet over the body or box 44**.

A vertical tubular shank 62 extends between confronting concrete blocks 20*a*. The thickness of the shank may require notching of the blocks, although they may simply be spaced apart a bit farther than in the first embodiment of the invention. The tubular shank 62 is made of an elastic material, preferably an elastomeric or rubber-like material which has an upper generally circular flange integral with the shank and bonded to the lower face of a respective disk or plate 22*a*. Similarly, there is an integral lower flange 66 on the vertical tubular shank 62 which is bonded to the upper face of the top wall 58 of the outer shell 56.

Normally the parts are held in the position shown in FIGS. 6 and 7 with the concrete blocks 20*a* resting on top of the foam plastic insulation slabs 18*a*, and the latter lying on the upper surface of the membrane 16*a*. In the case of a wind that might tend to raise the concrete blocks, the vertical tubular shank 62 will stretch to allow the blocks to rise as shown in FIG. 8. The insulating slabs may also rise, although this is not specifically illustrated. Upon diminution or cessation of the wind, the elasticity of the material of the vertical tubular shank 62 will again return the parts to the position shown in FIGS. 6 and 7.

It will be observed that the modification of the invention shown in FIGS. 5–8 has an added advantage of anchoring the membrane 16*a* to the roof deck 12*a* without requiring adhesives, this being accomplished by the gripping of portions of the membrane by the bodies 44 and outer shells 66 at spaced locations.

In both embodiments of the invention illustrated, the overlying disks or plates 22, 22*a* span joints of the concrete paving blocks to hold them down resiliently by means of the corresponding spring or elastic member. The concrete blocks are held down without disturbing the integrity of the waterproof diaphragm. The resulting roof construction is wind-resistant in that the concrete paving blocks can rise up against the resilient force of the springs or elastic members to relieve stresses in the roofing system. The resilient anchoring structure promptly restores the concrete paving blocks and the foam plastic insulation if necessary to rest position on the roof deck.

The specific examples of the invention as herein shown and described are for illustrative purposes only. Various changes in structure will no doubt occur to those skilled in the art and will be understood as forming a part of the present invention insofar as they fall within the spirit and scope of the appended claims.

The invention is claimed as follows:

1. A wind-resistant built up roof construction comprising a roof deck, a waterproof membrane overlying said roof deck, a plurality of insulating members overlying said membrane and comprising blocks of closed cell foam plastic resin material, a plurality of paving blocks overlying and supported by said insulating members in edge-to-edge relationship, a plurality of resilient members secured relative to said membrane and extending outwardly thereof, a plurality of hold-down members each overlying a plurality of said paving blocks and aligned with one of said resilient members, and said resilient members including means extending between adjacent paving blocks and interconnecting each hold-down member and a respective resilient member in order resiliently to hold said paving blocks in place for permitting movement of the paving blocks under wind loads without substantial movement of the waterproof membrane relative to said deck.

2. A roof construction as set forth in claim 1 wherein each hold-down member comprises a flat plate.

3. A roof construction as set forth in claim 2 wherein each flat plate comprises a disk.

4. A roof construction as set forth in claim 1 wherein said membrane is secured to said roof deck and wherein said membrane is provided with a plurality of anchors to which said respective resilient members are secured.

5. A roof construction as set forth in claim 1 wherein each resilient member comprises a spring.

6. A roof construction as set forth in claim 4 wherein each resilient member comprises a spring.

7. A roof construction as set forth in claim 1 wherein each resilient member comprises an elastomeric member.

8. A roof construction as set forth in claim 7 wherein each hold-down member comprises a flat plate, and said resilient member is attached to the lower surface of said plate.

9. A roof construction as set forth in claim 1 and further including a plurality of base members disposed under said membrane and anchored to said deck, a like plurality of overlying members each respectively gripping a section of said membrane to one of said base members, said resilient member respectively being connected to said overlying members.

10. A roof construction as set forth in claim 9 wherein each resilient member comprises an elastic member.

11. A roof construction as set forth in claim 10 wherein each hold-down member comprises a flat plate, and each elastic member is attached to a respective flat plate and to a respective overlying member.

* * * * *